United States Patent [19]

Reeves

[11] 3,965,827

[45] June 29, 1976

[54] CRIMINAL TRAP

[76] Inventor: Tom Reeves, 1216 Circle St., Winchester, Va. 22601

[22] Filed: Dec. 2, 1974

[21] Appl. No.: 528,890

[52] U.S. Cl. ..... 109/3; 109/20
[51] Int. Cl.[2] ..... E05G 5/02
[58] Field of Search ..... 109/2, 3, 20, 21, 29, 109/10, 11, 4

[56] References Cited

UNITED STATES PATENTS

| | | | |
|---|---|---|---|
| 2,053,035 | 9/1936 | Jackson et al. | 109/3 X |
| 3,230,912 | 1/1966 | Hohmann | 109/20 |

FOREIGN PATENTS OR APPLICATIONS

| | | | |
|---|---|---|---|
| 1,494,134 | 7/1967 | France | 109/3 |

*Primary Examiner*—Paul R. Gilliam
*Assistant Examiner*—David H. Corbin
*Attorney, Agent, or Firm*—Marden S. Gordon

[57] ABSTRACT

A trap for a criminal intended for use in a bank and including a bullet-proof transparent cage suspended in front of a teller's position and which drops over a criminal holding up the teller upon activation of an alarm device to totally entrap and enclose the criminal therein, and further including a gas canister automatically activated upon the entrapment of the criminal to deploy an anesthetic type gas to render the criminal helpless within the cage until the arrival of law enforcement personnel.

3 Claims, 3 Drawing Figures

10
11
12
13
14
15
16
17
18
19
21
22
23
24
31
32
33
34
35
36
37
39
41
42
51
52
53
54
55
56
57
58
59
61
62
63
64
71
72
73
74
75
76
77
81

CRIMINAL TRAP

BACKGROUND OF THE INVENTION

1. Field of the Invention

This invention relates generally to traps and more particularly to a novel criminal trap intended for use in banks and the like for entrapping a criminal in a bullet proof cage and anesthetizing the criminal until the arrival of law enforcement personnel.

2. Description of the Prior Art

In recent years all types of crimes have been on the increase, with one of the major crimes prevalent throughout the country being the holding up of banks and similar money institutions by an individual holding up an individual teller of the bank. While various alarm systems have been developed to signal the teller being robbed, due to the potential danger and hazard to surrounding bank customers and bank personnel, it has generally been decided not to attempt to stop the holdup man in the bank, especially if armed or giving the appearance of being armed.

Thus, various alarm systems presently in use are of the silent alarm type in that they sound no audible warning within the bank but rather signal law enforcement officials and guards of the bank who then attempt to seize the individual performing the holdup of the bank when leaving the bank. Such law enforcement officials and bank guards are thus subjected to the risk of bodily harm and death if the holdup individual is armed with a weapon.

SUMMARY OF THE INVENTION

The present invention recognizes the plight of law enforcement officials and bank guards in attempting to seize an armed individual who has performed a bank holdup, and provides a novel solution thereto in the form of a bullet proof cage adapted to drop over and completely envelop a holdup individual to completely entrap the individual therein, and to simultaneously discharge an anesthetic gas into the enclosure to render the holdup individual harmless until arrival of law enforcement personnel.

It is a feature of the present invention to provide a criminal trap intended for use in banks and similar institutions.

A further feature of the present invention provides a criminal trap which is relatively simple in its construction such that it is easy to use and reliable and efficient in operation.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCIPTION OF THE PREFERRED EMBODIMENT

Figures 1, 2, 3:
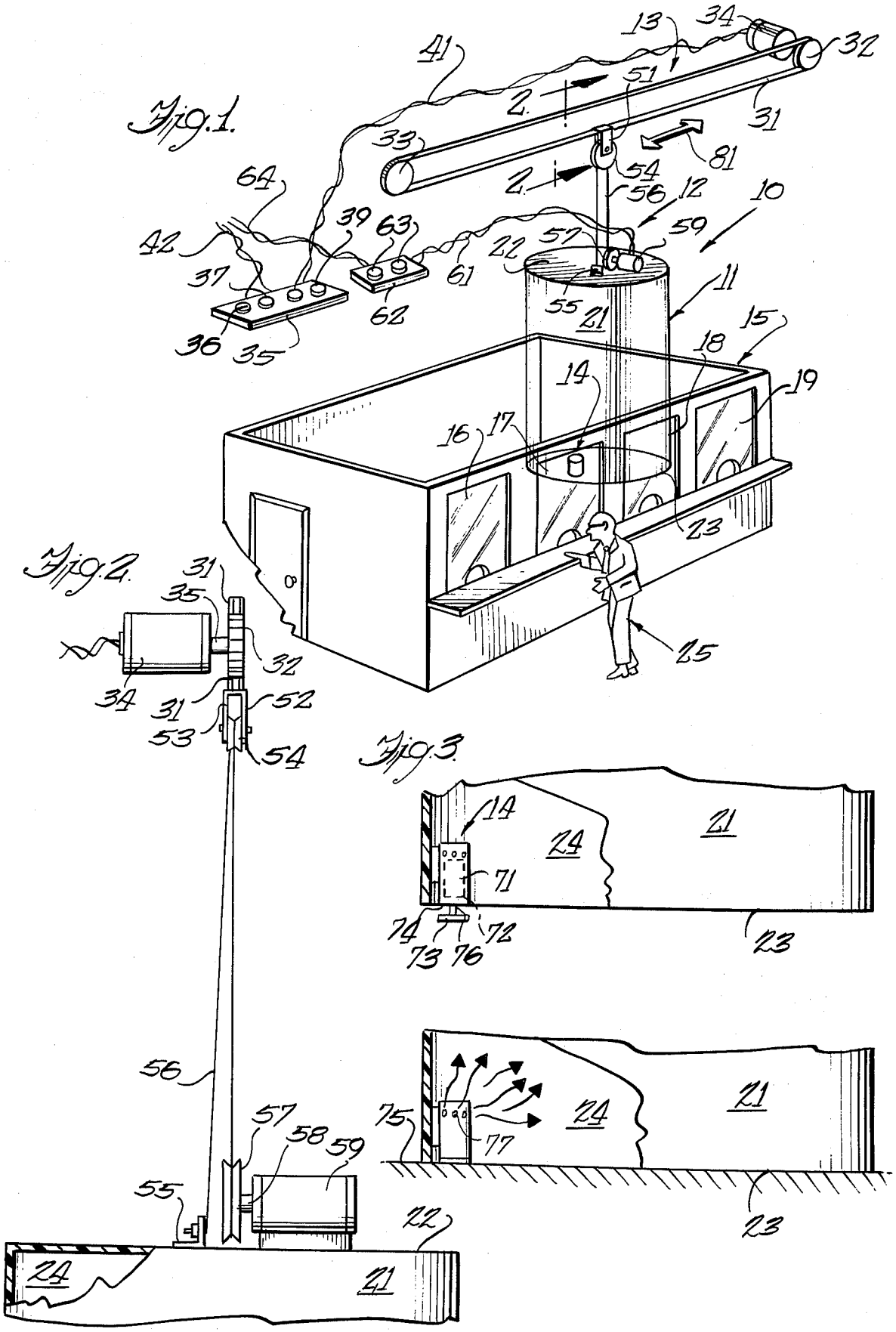
FIG. 1 is a perspective view of the criminal trap of the present invention.
FIG. 2 is an enlarged cross-sectional view taken along line 2—2 of FIG. 1.
FIG. 3 is a fragmentary front elevational view of a botton end portion of the trap illustrating the gas canister with the trap shown in both an elevated position with the canister de-energized and a closed floor-engaging position with the canister actuated.

Referring now to the drawings in detail there is illustrated a preferred form of a criminal trap constructed in accordance with the principles of the present invention and which is designated generally in its entirety by the reference numeral 10 and which is comprised of a bullet proof cage or enclosure 11, a raising and lowering mechanism 12, and a positioning mechanism 13, and a gas canister 14.

The cage or enclosure 11 is of an elongated hollow cylindrical configuration consisting of cylindrical side walls 21, a flat closed top end 22, and an open bottom end 23 providing access therethrough to the hollow interior 24 of the cage. The cage 11 is of a sufficient diameter and height to readily envelop therein an individual, such as designated by reference numeral 25 in FIG. 1.

The positioning mechanism 13 is generally positioned parallel to the front of the series of tellers' cages 15 having individual teller's positions 16–19. Disposed parallel to the teller windows 16–19 in a position forwardly thereof is a flexible endless chain 31 disposed in an elongated loop with the opposite ends passed over sprockets 32 and 33 which are disposed at opposite ends of the tellers' cage assembly 15 in the ceiling thereabove. An electric motor 34 is provided with its shaft 35 concentric to sprocket 32 for driving the same in opposite directions about its axis to move chain 31 in opposite direction thereabout, the direction of movement of the motor 34 being controlled by an electrical panel 35 which is positioned behind each of the teller's windows 16–19 and is provided with four position selector switches 36–39 each corresponding to one of the teller windows 16–19 respectively. The motor 34 is connected to panel 35 by suitable electrical wiring 41, with the panel being connected by suitably insulated electrical wiring 42 to a suitable source of electrical power.

The raising and lowering mechanism 12 consists of a U-shaped bracket 51 affixed to the bottom run of chain 31 and having leg portions 52 and 53 with there being rotatively supported therebetween a pulley 54. Affixed to the top flat end 22 of cage 11 is an L-shaped bracket 55 having one end of a cord 56 affixed thereto, the cord passing upwardly therefrom over pulley 54 and thence downwardly where it is wrapped about a pulley type wheel 57 rotatively supported on a motor shaft 58 of electric motor 59. The motor 59 is connected by suitably insulated electrical wiring 61 to a control panel 62 having electrical switches 63 therein for controlling the energization and de-energization of the motor 59. Panel 62 is connected by suitably insulated electrical wiring 64 to a suitable source of electrical energy.

The gas canister 14 is mounted to the interior of side wall 21 adjacent bottom edge 23 and projects inwardly of compartment 24 and is of a general cylindrical configuration 71 containing a sealed cartridge 72 of anesthetic gas therein. A plunger 73 is affixed to the bottom end 74 of the housing 71 and projects downwardly of the cage bottom edge 23, this being seen in FIG. 3. When the cage 23 is dropped to the floor 75, the plunger 73 engages the floor and drives its shaft 76 vertically upwardly to penetrate the sealed gas container 72 which then emits the anesthetic gas fumes therefrom through the interior of housing 71 and out of apertures 77 into the compartment 24 to anesthetize an individual entrapped within the cage 11.

In operation, an individual holdup man 25 is illustrated in FIG. 1 as holding up the teller of window 17. The teller actuates the alarm button which signals a bank guard of the holdup. The bank guard then pushes button 37 on panel 35 which energizes motor 34 to move the cage 11 in the direction of arrow 81 to position the cage above the outside area of window 17. When so positioned, the guard then actuates switch 63 which releases motor 59 and permits the cage 11 to drop vertically of its own weight in a rapid manner to envelop holdup individual 25 within the bulletproof cage. Upon the cage dropping the plunger 73 of gas canister 14 strikes the floor 75 to penetrate the sealed gas canister 72 and thus to emit anesthetic fumes through aperture 77 into the compartment 24 to anesthetize the holdup man 25 and thus render him harmless until the arrival of law enforcement personnel. When law enforcement personnel are present, and after the individual has been anesthetized, the cage 11 is raised by motor 59 back into a hidden ceiling position with the law enforcement personnel removing the holdup individual 25 from the premises.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. A criminal trap intended for use in banks and similar institutions and positioned forwardly of and spaced above a series of side-by-side tellers' windows, the trap comprising, in combination:

a hollow open bottom cylindrical cage body member manufactured of bullet proof material and having cylindrical side walls, a flat top end, and an open bottom end;

a hollow cylindrically shaped compartment defined interiorly of said cage body member opening out of the bottom end thereof and of a size and configuration adapted to readily envelope therein an individual over which the cage body member is lowered;

a pair of horizontally spaced apart tandemly disposed sprocket members each rotatively mounted about their axis and disposed in parallel relationship to each other and adapted to be rotatably mounted above opposite ends of the series of tellers windows;

an endless continuous chain trained over said sprockets and having an upper run and a lower run;

means for raising and lowering said cage body member in a vertical direction;

means affixing said vertical raising and lowering means to said chain for positioning said cage body member in a horizontal direction;

an electrical motor connected to the axis of one of said sprockets for drivingly moving said chain in selected opposite directions thereabout;

a multi-positioned electrical panel connected to said electric motor by suitably insulated electrical wiring and connected to a suitable source of electrical energy for selective control of said energization and de-energization of said electric motor for movement of said chain about said sprockets; and means for dispensing anesthetizing gas into said cage compartment upon the lowering of said cage body member.

2. The criminal trap as set forth in claim 1 wherein said means for raising and lowering said cage body member comprises, in combination:

a U-shaped bracket having its bight portion affixed to said lower run of said chain and having its leg portions extending vertically downwardly from said chain;

a pulley member rotatively affixed between said bracket leg portions for free rotation thereabout;

a bracket affixed to said flat top end of said cage body member;

an electric motor affixed to said flat top end of said cage body member;

a pulley wheel member rotatively affixed to a shaft of said electric motor for driving rotation thereby;

a flexible cable having one end affixed to said cage top end bracket with said cable extending vertically upwardly therefrom and being trained over said pulley from whence it is directed vertically downwardly to have its opposite ends secured to said pulley wheel of said motor;

a control panel electrically connected to said motor by suitably insulated electrical wiring for selective energization and de-energization of said motor, said control panel being connected by suitably insulated electrical wiring to a suitable source of electrical energy;

whereby activation of said control panel effects the dropping of said cage in a manner to envelop a criminal standing there beneath, and activation of said control panel in the opposite direction effects energization of said motor to raise said cage and release said criminal individual.

3. The criminal trap as set forth in claim 2 wherein said gas dispensing means comprises, in combination:

a vertically disposed hollow cylindrical housing affixed to an interior side wall of said cage compartment adjacent said bottom edge of said cage body member;

a compartment defined interiorly of said housing;

apertures disposed in said housing in communication with said compartment;

a sealed gas canister adapted to be replaceably disposed in said compartment containing anesthetic gas therein; and a plunger affixed to a bottom end of said housing and projecting downwardly of said cage bottom edge, said plunger reciprocally movable relative to said housing between a position projecting downwardly of said cage bottom edge and a position projecting inwardly of said housing compartment to penetrate said sealed gas canister automatically upon the dropping of said cage to a floor surface surrounding said criminal individual such that anesthetic gas fumes are discharged into said housing compartment and pass through said apertures therein to pass into said cage compartment and anesthetize the criminal individual contained therein.

* * * * *